US007474207B2

(12) United States Patent
Yarsa et al.

(10) Patent No.: US 7,474,207 B2
(45) Date of Patent: Jan. 6, 2009

(54) AUTOMATIC NOTIFICATION IN A SEQUENTIAL PROCESS

(75) Inventors: Julianne Yarsa, Austin, TX (US); James Andre Rocke, Georgetown, TX (US)

(73) Assignee: International Business Machines Corporation, Armonk, NY (US)

( * ) Notice: Subject to any disclaimer, the term of this patent is extended or adjusted under 35 U.S.C. 154(b) by 279 days.

(21) Appl. No.: 11/427,170

(22) Filed: Jun. 28, 2006

(65) Prior Publication Data

US 2008/0001745 A1 Jan. 3, 2008

(51) Int. Cl.
*G08B 1/08* (2006.01)
*G08B 13/14* (2006.01)
*G06K 7/10* (2006.01)

(52) U.S. Cl. ..... 340/539.13; 340/572.1; 340/323 R; 235/377

(58) Field of Classification Search ..... None
See application file for complete search history.

(56) References Cited

U.S. PATENT DOCUMENTS 5,737,280 A 4/1998 Kokubo
5,812,049 A 9/1998 Uzi
6,301,197 B1 10/2001 Abbott et al.

FOREIGN PATENT DOCUMENTS

WO 2004104961 A1 12/2002

OTHER PUBLICATIONS

"Japanese Kids Get Radio ID'd", CBS News, Oct. 12, 2004, pp. 1-3.http://www.cbsnews.com/stories/2004/10/11/tech/printable648681.shtml, retrieved Jun. 27, 2006.

*Primary Examiner*—Julie Lieu
(74) *Attorney, Agent, or Firm*—Duke W. Yee; Jeffrey S. LaBaw; Peter B. Manzo

(57) ABSTRACT

A computer implemented method, data processing system, and computer program product that enable a component to prepare for the arrival of a moving component by providing, to the component, an automated notification of the moving component's approach. When a moving component approaches an arrival point, a signal is received from a transponder chip on the moving component, wherein the signal includes a unique identifier for the transponder chip. The moving component is then identified based on the unique identifier in the signal. A second signal is sent to the component to signal that initiation of a set of actions to be performed with respect to the moving component may occur.

3 Claims, 4 Drawing Sheets

AUTOMATIC NOTIFICATION IN A SEQUENTIAL PROCESS

BACKGROUND OF THE INVENTION

1. Field of the Invention

The present invention relates generally to an improved data processing system, and in particular to a computer implemented method, data processing system, and computer program product for enabling a component to prepare for the arrival of a moving component by providing, to the component, an automated notification of the moving component's approach.

2. Description of the Related Art

Evolving technologies allow components to be tagged with transponders and then identified by devices that read the information encoded into signals emitted by the transponders. An example of a transponder chip is a radio frequency identification device (RFID), which uses radio waves to automatically identify people or components. When a component containing an RFID tag transmits a radio signal comprising its unique identifier and other information, an RFID-enabled reader may receive the signal and identify the component. There are several methods of identification, but the most common is to store a "serial number" in the transponder chip that identifies the person or component, and perhaps other information, associated with the chip. The "serial number" may be used to specify the unique, numerical identifier of the component, thereby allowing a receiving device or reader to distinguish one component from another. Applications of this technology include tracking assets, managing inventory, automatic vehicle identification, highway toll collection, and authorizing payments.

One particular application of this technology is used in race timing of sports such as running, biking, skiing, etc. With the growth in the number of amateur runners in this country, the number and types of large road races has increased. One popular race format is the marathon relay race, in which a marathon distance (26.2 miles) is covered by a team of two to five (or more) runners. Transponder technology is often used as a supplement to traditional methods of race timing in these larger races to provide more accurate recording of race times and to provide instantaneous race updates. Small transponder chips are worn by the athletes and are used to identify the athletes as they cross strategically placed electronic mats in the path of the race.

Marathon relays operate in much the same way as traditional track relays. For example, each runner on a team is assigned a leg of the race, and the runners pass a baton (usually in the form of a wristband or some easily carried item) at set hand-off points. At the hand-off points, the arriving runners typically are funneled through a chute at some point along the length of which the hand-offs take place and the next-leg runners proceed. At many well-funded runs, race officials announce the bib numbers of the arriving runners at each hand-off point (each team has a unique number) through a loudspeaker so that the next-leg runner can position himself along the chute and be ready for a hand-off. At other runs, each team is responsible for spotting its arriving runner and making sure the next-leg runner is ready. In any case, hand-off points are usually chaotic, noisy, and crowded, and it is easy for the next-leg runner to fail to notice that his teammate has arrived at the hand-off point. This situation is especially true in large races, since a teammate may arrive in a large pack of runners as recreational runners run at similar paces.

SUMMARY OF THE INVENTION

The illustrative embodiments provide a computer implemented method, data processing system, and computer program product that enable a component to prepare for the arrival of a moving component by providing, to the component, an automated notification of the moving component's approach. When a moving component approaches an arrival point, a signal is received from a transponder chip on the moving component, wherein the signal includes a unique identifier for the transponder chip. The moving component is then identified based on the unique identifier in the signal. A second signal is sent to the component to signal that initiation of a set of actions to be performed with respect to the moving component may occur.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
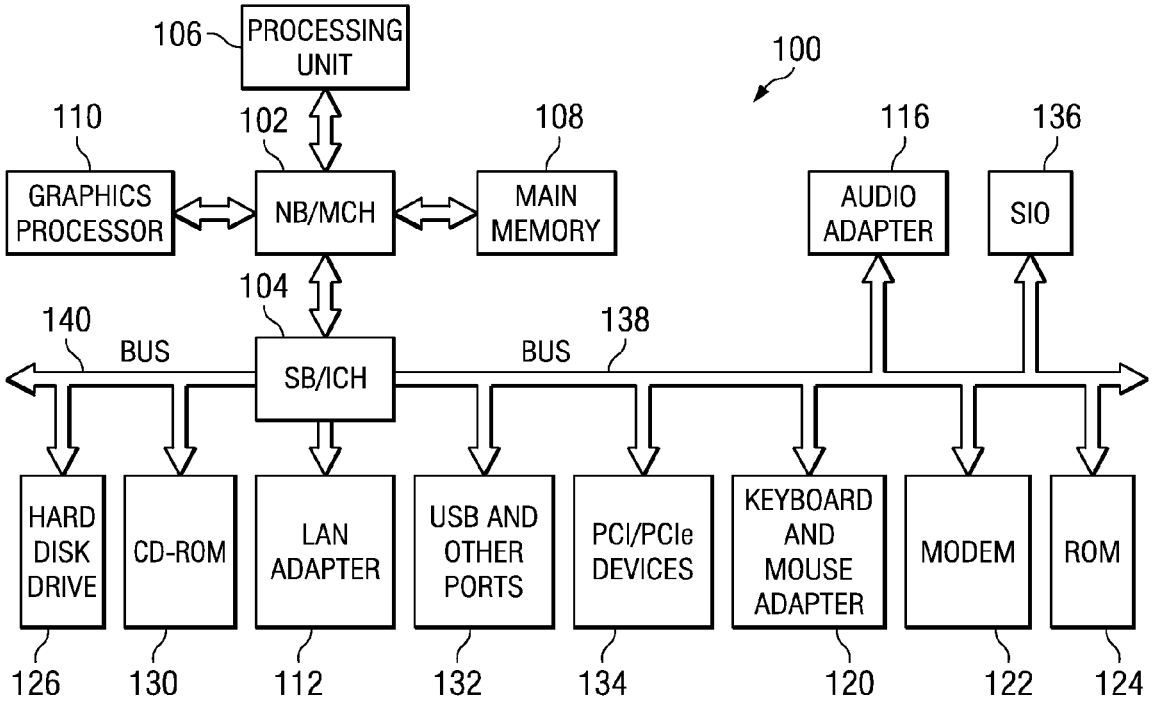
FIG. 1 is a block diagram of a data processing system in which the illustrative embodiments may be implemented.

With reference now to FIG. 1, a block diagram of a data processing system is shown in which the illustrative embodiments may be implemented. Data processing system 100 is an example of a computer in which computer usable code or instructions implementing the processes for the illustrative embodiments may be located.

In the depicted example, data processing system 100 employs a hub architecture including north bridge and memory controller hub (NB/MCH) 102 and south bridge and input/output (I/O) controller hub (SB/ICH) 104. Processing unit 106, main memory 108, and graphics processor 110 are connected to NB/MCH 102. Graphics processor 110 may be connected to NB/MCH 102 through an accelerated graphics port (AGP).

In the depicted example, local area network (LAN) adapter 112 connects to SB/ICH 104. Audio adapter 116, keyboard and mouse adapter 120, modem 122, read only memory (ROM) 124, hard disk drive (HDD) 126, CD-ROM drive 130, universal serial bus (USB) ports and other communication ports 132, and PCI/PCIe devices 134 connect to SB/ICH 104 through bus 138 and bus 140. PCI/PCIe devices may include, for example, Ethernet adapters, add-in cards, and PC cards for notebook computers. PCI uses a card bus controller, while PCIe does not. ROM 124 may be, for example, a flash binary input/output system (BIOS).

HDD 126 and CD-ROM drive 130 connect to SB/ICH 104 through bus 140. HDD 126 and CD-ROM drive 130 may use, for example, an integrated drive electronics (IDE) or serial advanced technology attachment (SATA) interface. Super I/O (SIO) device 136 may be connected to SB/ICH 104.

An operating system runs on processing unit 106 and coordinates and provides control of various components within data processing system 100 in FIG. 1. As a client, the operating system may be a commercially available operating system such as Microsoft® Windows® XP (Microsoft and Windows are trademarks of Microsoft Corporation in the United States, other countries, or both). An object-oriented programming system, such as the Java™ programming system, may run in conjunction with the operating system and provides calls to the operating system from Java™ programs or applications executing on data processing system 100 (Java is a trademark of Sun Microsystems, Inc. in the United States, other countries, or both).

As a server, data processing system 100 may be, for example, an IBM® eServer™ pSeries® computer system, running the Advanced Interactive Executive (AIX®) operating system or the LINUX® operating system (eServer, pSeries and AIX are trademarks of International Business Machines Corporation in the United States, other countries, or both while LINUX is a trademark of Linus Torvalds in the United States, other countries, or both). Data processing system 100 may be a symmetric multiprocessor (SMP) system including a plurality of processors in processing unit 106. Alternatively, a single processor system may be employed.

Instructions for the operating system, the object-oriented programming system, and applications or programs are located on storage devices, such as HDD 126, and may be loaded into main memory 108 for execution by processing unit 106. The processes for the illustrative embodiments are performed by processing unit 106 using computer usable program code, which may be located in a memory such as, for example, main memory 108, ROM 124, or in one or more peripheral devices 126 and 130.

Those of ordinary skill in the art will appreciate that the hardware in FIG. 1 may vary depending on the implementation. Other internal hardware or peripheral devices, such as flash memory, equivalent non-volatile memory, or optical disk drives and the like, may be used in addition to or in place of the hardware depicted in FIG. 1. Also, the processes of the illustrative embodiments may be applied to a multiprocessor data processing system.

In some illustrative examples, data processing system 100 may be a personal digital assistant (PDA), which is configured with flash memory to provide non-volatile memory for storing operating system files and/or user-generated data.

A bus system may be comprised of one or more buses, such as bus 138 or bus 140. Of course, the bus system may be implemented using any type of communication fabric or architecture that provides for a transfer of data between different components or devices attached to the fabric or architecture. A communication unit may include one or more devices used to transmit and receive data, such as modem 122 or network adapter 112. A memory may be, for example, main memory 108, ROM 124, or a cache such as found in NB/MCH 102. The depicted examples in FIG. 1 and above-described examples are not meant to imply architectural limitations. For example, data processing system 100 also may be a tablet computer, laptop computer, or telephone device in addition to taking the form of a PDA.

The illustrative embodiments provide a computer implemented method, data processing system, and computer program product for an automated notification system. The automated notification system enables a set of actions to be initiated by notifying a component that a moving component is approaching. A component may take many forms. For instance, a component may be a physical device, such as a baton or clothing (e.g., running shoes) in the case of a relay race, or an assembly part or assembly operator mechanism in the case of an assembly line. A component may also take the form of an entirely hardware embodiment, such as an ASIC chip, or an entirely software embodiment, such as firmware, resident software, or microcode, or an embodiment containing both hardware and software elements.

An approach of a moving component may include the moving component moving within a designated distance of an arrival point. With the automated notification system, when a moving component moves within a designated distance of an arrival point, a notification of the moving component's approach is provided to a receiving component, without requiring the receiving component visually confirm the approach of the approaching component or that a verbal announcement of the approach be made to the receiving component. Upon receiving the notification, action may be taken based on the information received.

The illustrative embodiments also allow for using the automated notification to provide instructions to the receiving component in the data processing system. For example, when a notification of a moving component is received, the receiving component may perform a set of actions or tasks to prepare for the moving component's arrival at an arrival point. Thus, rather than a receiving component having to guess or anticipate when the moving component will arrive at the arrival point, the receiving component is notified of the approach of the moving component, as well as is provided with instructions for performing a set of actions or tasks associated with the moving component. The automated notification enables synchronization between the preparation for a moving component's arrival and performing the designated actions or tasks associated with the moving component, such that the receiving component is ready "at just the right time" for the moving component's arrival. Consequently, a receiving component may prepare for a moving component's arrival and seamlessly perform designated tasks without requiring visual or verbal cues as to the approach of the moving component.

Figure 2:
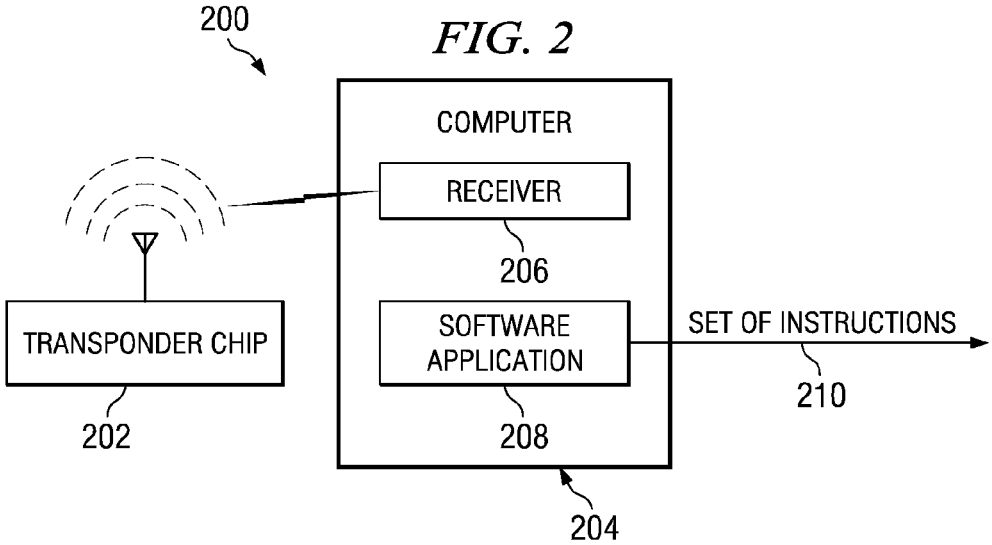
FIG. 2 is a high-level block diagram of components in which the illustrative embodiments may be implemented.

Turning now to FIG. 2, a high-level block diagram is depicted in which the illustrative embodiments may be implemented. In this illustrative example, automated notification system 200 comprises transponder chip 202 and computer 204. Transponder chip 202, or tag, comprises a microchip that is attached to an antenna. Transponder chip 202 is a wireless communications device capable of receiving and automatically responding to incoming signals. Transponder chip 202 stores information to be transmitted wirelessly in an automated fashion to specialized receivers, such as receiver 206 in computer 204. Transponder chip 202 may be an active or passive transponder. For example, a passive transponder will send no signals to a receiver until the transponder itself receives an incoming signal or it is placed within, for example, a magnetic field. In placed within a magnetic field, the magnetic field may cause a coil within the chip to produce an electric current to power the transponder and allow the transponder to transmit a signal.

Another example of a transponder chip is a radio frequency identification device (RFID), which uses radio waves to automatically identify people or components. For example, when a component containing an RFID tag transmits a radio signal comprising its unique identifier and other information, an RFID-enabled reader may receive the signal and identify the component. In either case, the signal transmitted by transponder chip 202 may then be used to identify people or components.

Transponder chip 202 transmits a signal comprising the unique identifier of the chip to computer 204. Computer 204 is an example of a data processing system, such as data processing system 100 described in FIG. 1. Computer 204 includes receiver 206 for receiving the signal from transponder chip 202. An example of a receiver is a radio frequency receiver, which uses an antenna to receive transmitted radio signals from another. Computer 204 also includes software application 208. Software application 208 comprises software programmed to associate transponder chip 202 with the signals the transponder chip sends and receives. Upon receiving an incoming signal at computer 204, software application 208 is used to identify the transponder chip sending the signal. Based on the identification of the transponder chip, software application 208 may also provide a set of instructions 210 to other transponder chips or components in the data processing system. Set of instructions 210 may include a signal that alerts a user to perform one or more tasks or it may include commands for a component in the data processing system to carry out. In this manner, software application 208 may direct the action to be taken in response to receiving a signal from transponder chip 202.

Figure 3:
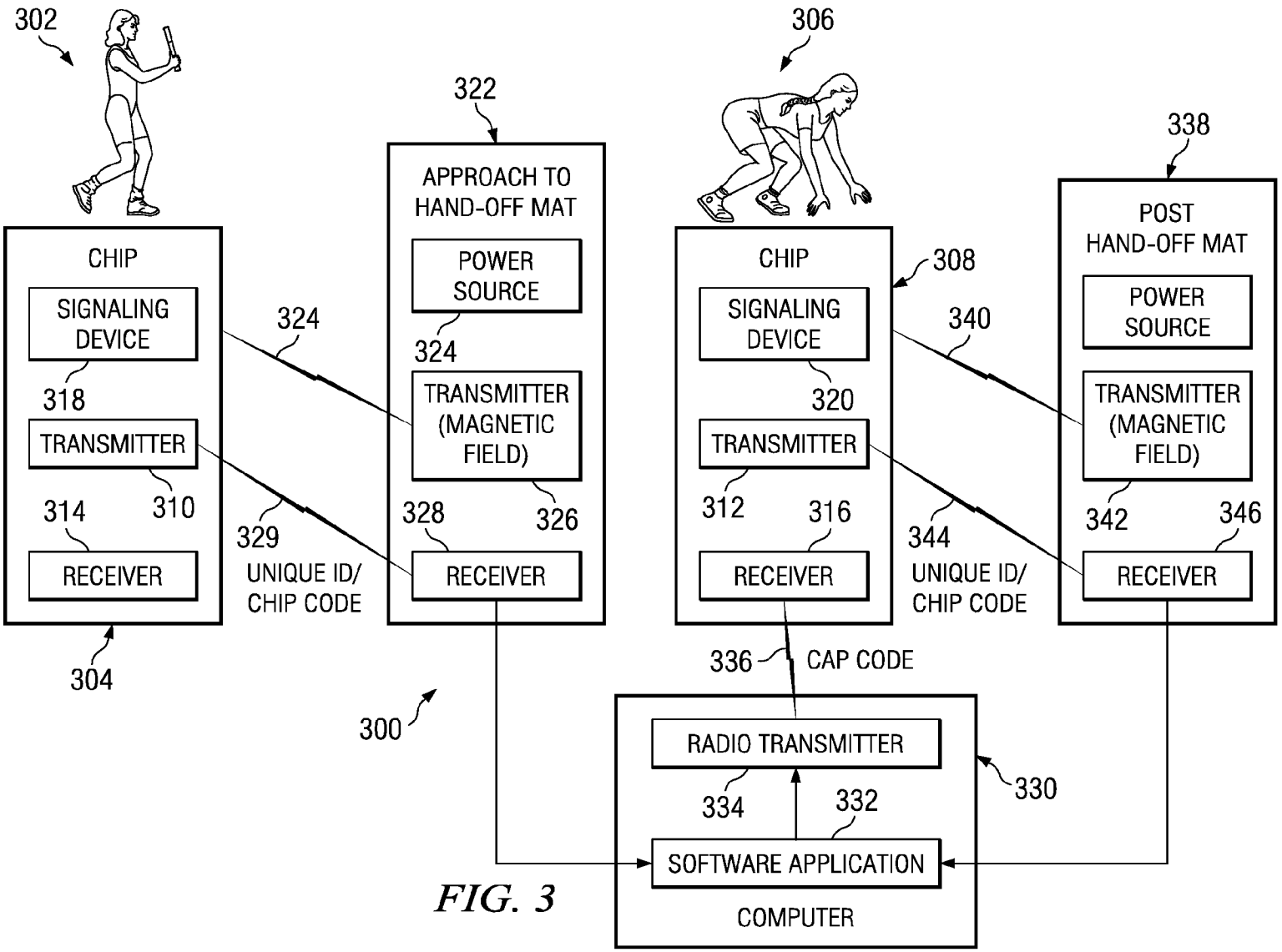
FIG. 3 is a block diagram of components used to implement an automated relay notification system in accordance with the illustrative embodiments.

FIG. 3 is a block diagram of exemplary components used to implement an automated relay notification system in accordance with the illustrative embodiments. In this illustrative example, automated relay notification system 300 may be used to notify one or more relay race team members of a teammate's approach to a hand-off point. Rather than requiring that the second runner see the teammate approaching the hand-off point or hear an announcement of the second runner's team number, automated relay notification system 300 takes the guesswork out of determining when a teammate is approaching and makes the relay experience more efficient and enjoyable.

Automated relay notification system 300 comprises modified transponder chips, receivers, radio frequency transmitters, and specialized software. Transponder chips are frequently used for timing results in large modern road races. Typically, runners wear a small timing chip that is used to identify each runner when the runners cross a threshold, such as the starting or finish line. Electronic mats may be used as starting or finish line thresholds. When a runner crosses an electronic mat, the timing chip is activated by a magnetic field emitted from the mat. The timing chip sends a signal with the runner's unique ID. This signal is captured by receivers on the mat and provided to a computer to record the time(s) of the identified runner.

While current timing chips are passive transponders activated by crossing a magnetic field at select spots on a race course, the transponder chips may each comprise a combination of a passive transponder (i.e., no internal power source) and a battery-powered receiver/pager. For instance, when relay runner 1 302 wearing transponder chip 304 crosses a magnetic field set up at some distance approaching a hand-off point, one or more other transponder chips worn by the other relay teammates, such as runner 2 306 wearing transponder chip 308, will be paged to notify the team of the arriving runner's approach. By notifying the other runners on the team, the runner of the next leg may position himself accordingly in the hand-off chute. In addition, when runner 2 306 begins his leg of the relay, he may cross another magnetic field set up at some distance after the hand-off point. Crossing the other magnetic field signals the notification system to stop the paging.

Consider a particular scenario in which a five-person team is running a marathon relay. Each transponder chip worn by the team members, including transponder chips 304 and 308, has a unique ID or chip code. In this illustrative example, transponder chip 304 may be worn in a typical manner by runner 1 302, such as on the runner's shoelace or clothing. Transponder chips 304 and 308 are modified in this example to each include a transmitter (310, 312) receiver (314, 316), and signaling device (318, 320). Transmitters 310 and 312 are used to detect an incoming signal and automatically respond to the signal. For example, when runner 1 302 wearing transponder chip 304 approaches a hand-off point with runner 2 306, runner 1 302 crosses approach-to-hand-off mat 322. Approach-to-hand-off mat 322 may comprise a power source 324, transmitter 326, and a receiver 328. A transmitter within approach-to-hand-off mat 322 generates a magnetic field 324 and causes the coil within transponder 310 to produce an electric current to power the transponder and allow the transponder to transmit signal 329. Signal 329 is comprised of the unique ID or chip code for transponder chip 304.

An antenna, such as receiver 328 on approach-to-hand-off mat 322, captures signal 329 comprising the unique ID of transponder chip 304. This signal is sent to a computing device, such as computer 330. Within computer 330, software application 332 is used to associate a set of transponder chips with respect to signals they send and receive. For instance, the unique IDs of the five transponder chips of the team are associated with each another in software application 332. In addition, software application 332 associates the team's transponder chips with a single Channel Access Protocol (CAP) code, which is a unique identification sequence that is used by the transponders to identify which signals are intended for the team. A different CAP code is associated with the set of transponder chips for each team.

Upon receiving the unique ID/chip code, software application 332 determines which CAP code should be broadcast based on the unique ID in the incoming signal. Software application 332 directs radio transmitter 334 to broadcast the identified CAP code 336 at the frequency to which the receivers, such as receivers 314 and 316, of the team's five transponder chips are tuned. Software application 332 may also update and store the current mode of the group of transponder chips. As the radio transmitter at this point is broadcasting the CAP code to the team's transponders to notify the team members of runner 1's approach, the five transponder chips are now in "notify" mode.

The receivers in the five transponder chips are all programmed to listen for their frequency/CAP code being broadcast by radio transmitter 334. When receiver 316 in transponder chip 308 detects the transmission of it associated CAP code 336, signaling device 320 in transponder chip 308 is used to notify the chip wearer that a teammate is approaching the hand-off point. Signaling device 320 is used to provide at least one of visual, audio, or tactile notifications to the teammates, such as, for example, emitting particular sounds to gain the participant's attention, changing the appearance of the transponder chip (e.g., flashing light emitting diodes (LED) attached to the chip), causing the chip to vibrate, or a combination of any of the above. Signaling device 320 may also be battery-powered to allow for mobility of the chip wearer. Regardless of the manner of notification, the teammate running the next leg of the relay (runner 2 306) is now aware that his teammate (runner 1 302) will soon be arriving at the hand-off point. As a consequence of the notification, runner 2 306 will prepare for the hand-off by positioning himself in or near the hand-off chute.

Notifications from the signaling devices may be terminated in various ways. For instance, while the notifications are continually being provided to the team members, runner 2 306 performs the hand-off and starts his leg of the relay, thereby running out of range of radio transmitter 334. As a result, signaling device 320, no longer receiving the signal transmitter from radio transmitter 334, stops the notification. In another embodiment, at some time after the hand-off occurs, runner 2 306 passes over post hand-off mat 338 a short distance from the hand-off point. Magnetic field 340 emitted from transmitter 342 on post hand-off mat 338 causes transponder chip 308 to emit its unique ID or chip code 344. An antenna (receiver 346) in the mat captures chip code 344 and sends the chip code to the software application 332. Based on the chip code received, software application 332 determines that transponder chip 308 (and its associated chips for the team) is currently in "notify" mode. Software application 332 then directs radio transmitter 334 to cease transmitting the specific CAP code and, as a result, signaling devices on all chips responding to that CAP code will stop the notification. Software application 332 may then update the current mode for the team's transponder chips.

As described above, the transponder chips and software application may be programmed to support a one-to-many association between an individual chip and the group with which it is associated (i.e., any chip worn by a runner may signal all of the other chips worn by the runner's team members to notify or stop notifying). Alternatively, the transponder chips and software application may be programmed to support a strict one-to-one association of the transponder chips, wherein each chip signals only one other chip in the group. For example, only the chip worn by the second runner is notified of the first runner's approach, only the chip worn by the third runner is notified of the approach of the second runner, etc. In this particular case, the team should be careful that each transponder chip is available at its correct hand-off point.

Figure 4:
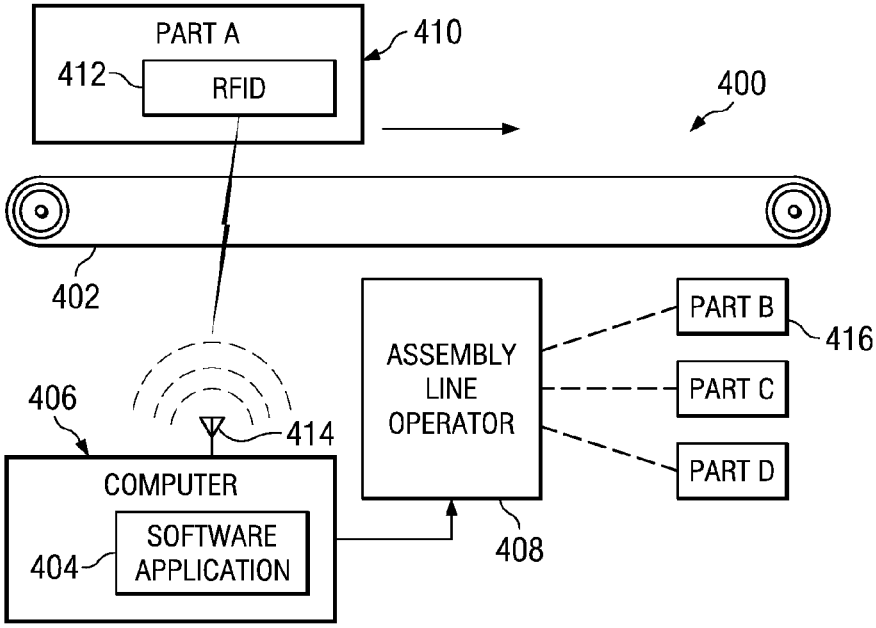
FIG. 4 is a block diagram of exemplary components used to implement an automated assembly line notification system in accordance with the illustrative embodiments.

FIG. 4 is a block diagram of exemplary components used to implement an automated assembly line notification system in accordance with the illustrative embodiments. In this illustrative example, automated assembly line notification system 400 comprises an assembly line 402, software application 404 in computer 406, and assembly line operator 408. Assembly line 402 may be a conveyor belt that is used to move a component comprised of a plurality of parts through various stages of assembly. In this example, part A 410 of the component is placed on the conveyor belt and moved forward towards the next assembly station. A transponder, such as RFID tag 412, is located with part A 410. Located with, in this example, may include the transponder being attached onto the part, integrated within the part, or within a specific distance of the part. RFID tag 412 may be a passive device, which uses power emitted from adjacent antennas as its energy source.

In this example, computer 406 includes antenna 414, which emits a radio frequency signal. The antenna powers passive RFID tag 412 on part A 410, and the RFID tag responds to the signal by emitting the unique ID of the tag. The unique ID of the tag is sent to software application 404. Based on the unique ID, software application 404 determines whether one or more parts are needed at the next assembly station. If a part, such as part B 416, is needed, software application sends a set of instructions to assembly line operator 408 to prepare for the arrival of the component at the next assembly station by fetching part B 416 to be assembled onto the component. Thus, automated assembly line notification system 400 allows for notifying an assembly operator at a station of the approach of the moving component, as well as directing the assembly operator to gather specific parts needed for assembly of the moving component. In this manner, a more coherent and efficient operation may be obtained by providing automated notification and issuing instructions to be performed in preparation for the moving component's arrival at the arrival point.

Figure 5:
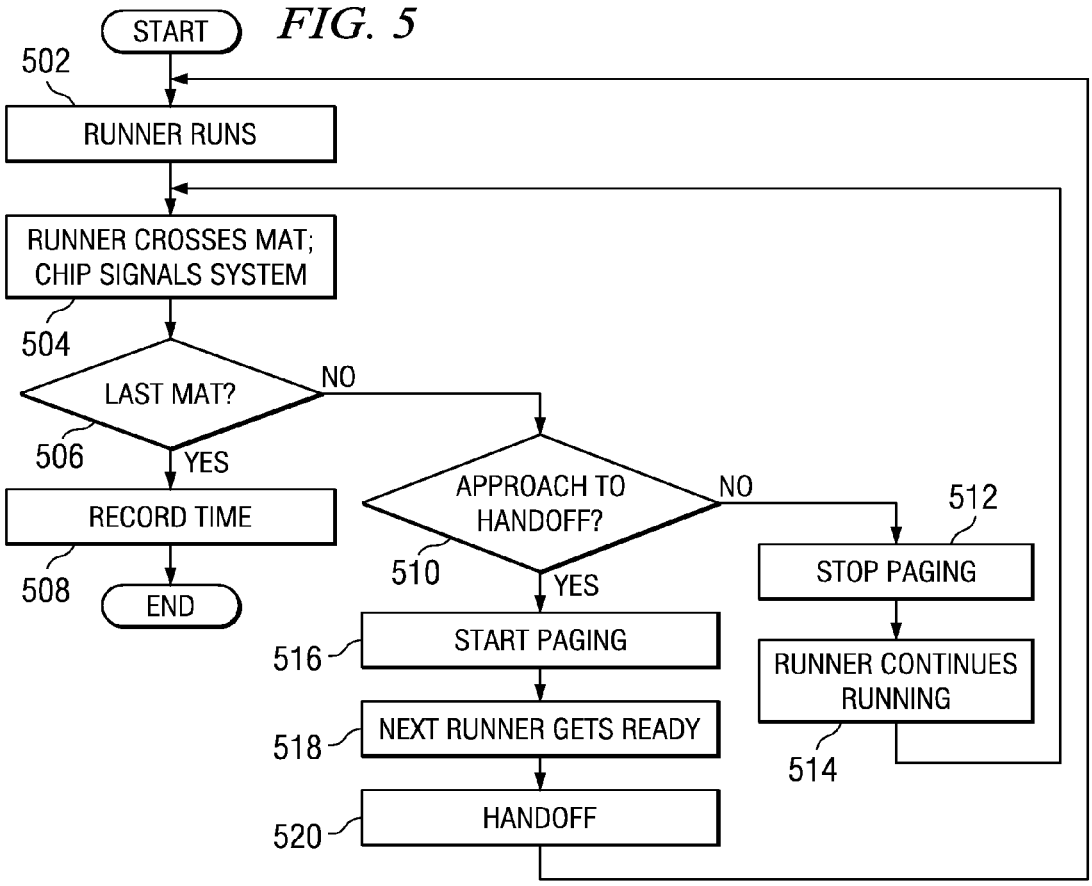
FIG. 5 is a flowchart of a process for providing an automated notification of a runner's approach in a relay in accordance with the illustrative embodiments.

FIG. 5 is a flowchart of a process for providing an automated notification of a runner's approach in a relay in accordance with the illustrative embodiments. The process begins with a runner running his leg of a relay race (step 502). When the runner crosses an electronic mat placed in the runner's path, the transponder chip worn by the runner emits a signal comprising the unique ID of the transponder chip or chip code, and this signal is captured by an antenna in the mat and sent to a software application in a computing system (step 504). The software application then determines if the captured signal was sent from the last mat (i.e., finish line) in the relay race (step 506). If so, the software application records the time the runner crosses the mat (step 508), with the process terminating thereafter. The software may also associate the recorded time with the unique ID of the runner's transponder chip to determine the runner's time for the leg of the race, as well as use the unique ID to obtain the CAP code for the runner's team to determine the team's time for the entire race.

Turning back to step 506, if the software application determines that the captured signal was not sent from the last mat, the software application determines if the captured signal was sent from an approach-to-hand-off mat (step 510). This determination may be made by identifying the type of mat from which the software application receives the captured signal (i.e., approach-to-hand-off mat or post hand-off mat) or by checking the current "mode" (e.g., "notify") of the team's transponder chips. The software application itself may update and store the current mode of the group of chips as each mat is crossed, and use this information to determine the mode when the next mat is crossed.

If the software application determines that the captured signal was not sent from an approach-to-hand-off mat (e.g., sent from a post hand-off mat), the software application determines that the current mode of the team's transponder chips is in "notify" mode and directs the radio transmitter to stop paging the team's transponder chips (step 512). The runner continues running (step 514), and the process loops back to step 504 to execute at each hand-off point in the course.

Turning back to step 510, if the software application determines that the captured signal was sent from an approach-to-hand-off mat, the software application directs the radio transmitter to start paging the team's transponder chips to notify the team that a runner is approaching the hand-off point (step 516). In response to the notification, the next-leg runner gets ready to receive the hand-off by positioning himself in or alongside the chute (step 518). The hand-off then occurs (step 520), and the process loops back to step 502 as the runner receiving the hand-off begins running his leg of the relay race.

Figure 6:
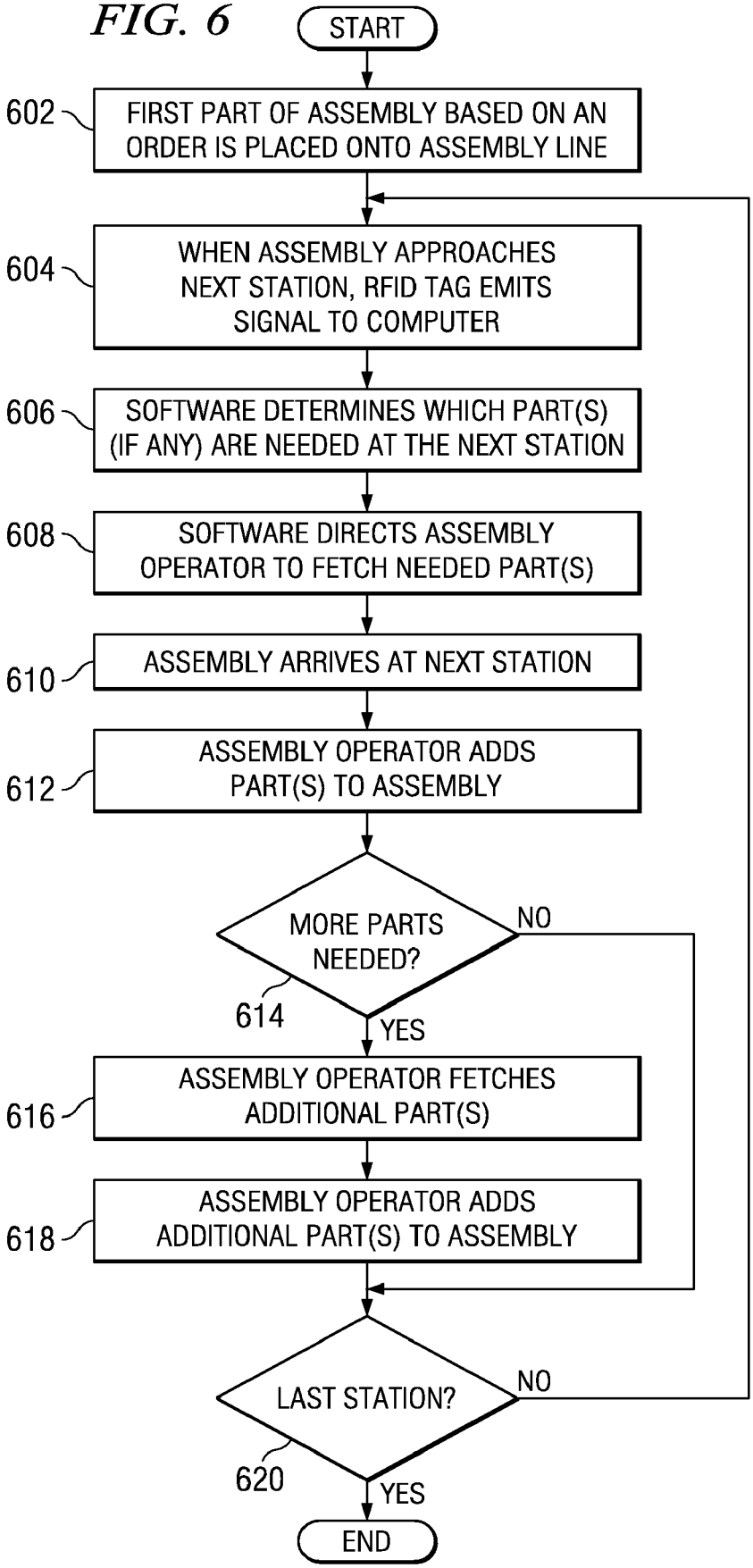
FIG. 6 is a flowchart of a process for providing an automated notification of needed assembly parts in an assembly line in accordance with the illustrative embodiments.

FIG. 6 is a flowchart of a process for providing an automated notification of needed assembly parts in an assembly line in accordance with the illustrative embodiments. The process described in FIG. 6 may be performed when an order for an assembled component is received at the assembly line.

The process begins with a first part in an assembly being placed on the assembly line based on the order received (step 602). A transponder such as RFID tag is attached to the part. When the first part of the assembly approaches the next station in the assembly line, the RFID tag receives a radio frequency signal which powers the tag, and the RFID tag responds to the signal by emitting the unique ID of the tag (step 604). The unique ID of the tag is provided to a software application in a computing system, and the software application uses the unique ID to determine which parts, if any, should be added to the assembly at the next station (step 606). Based on this determination, the software application directs the assembly operator or operating mechanism to fetch the needed parts in preparation for the arrival of the assembly (step 608). When the assembly arrives at the next station (step 610), the assembly operator or operating mechanism adds the fetched parts to the assembly (step 612).

Once the parts have been added to the assembly, a determination is made as to whether more parts are to be added to the assembly at the station (step 614). If more parts should be added, the assembly operator or operating mechanism fetches additional parts needed (step 616), and adds each additional part to the assembly (step 618). A determination is then made as to whether the current station is the last station in the assembly line (step 620). If current station is the last station, the process terminates thereafter. If the current station is not the last station in the assembly line, the process returns to step 604.

Turning back to step 614, if no additional parts are needed to be assembled at the station, the process skips to step 620, wherein the determination is made as to whether the current station is the last station in the assembly line. If current station is the last station, the process terminates thereafter. If the current station is not the last station in the assembly line, the process returns to step 604.

The invention can take the form of an entirely hardware embodiment, an entirely software embodiment or an embodiment containing both hardware and software elements. In a preferred embodiment, the invention is implemented in software, which includes but is not limited to firmware, resident software, microcode, etc.

Furthermore, the invention can take the form of a computer program product accessible from a computer-usable or computer-readable medium providing program code for use by or in connection with a computer or any instruction execution system. For the purposes of this description, a computer-usable or computer readable medium can be any tangible apparatus that can contain, store, communicate, propagate, or transport the program for use by or in connection with the instruction execution system, apparatus, or device.

The medium can be an electronic, magnetic, optical, electromagnetic, infrared, or semiconductor system (or apparatus or device). Examples of a computer-readable medium include a semiconductor or solid-state memory, magnetic tape, a removable computer diskette, a random access memory (RAM), a read-only memory (ROM), a rigid magnetic disk and an optical disk. Current examples of optical disks include compact disk—read only memory (CD-ROM), compact disk—read/write (CD-R/W), and digital video disc (DVD).

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modems, and Ethernet cards are just a few of the currently available types of network adapters.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A computer implemented method for automatically notifying a component of an approach of a moving component, the computer implemented method comprising:

receiving a signal generated by a radio frequency identification tag located with the moving component, wherein the signal is generated when the moving component moves within a selected distance of an arrival point, and wherein the signal includes a unique identifier for the moving component;

identifying the moving component based on the unique identifier in the signal;

sending a second signal to the component to signal that initiation of a set of actions is to be performed with respect to the moving component, wherein the second signal is received by a second radio frequency identification tag located with the component, and wherein the second radio frequency identification tag includes a transponder, receiver, and a signaling device, and wherein upon receiving the second signal the signaling device alerts the component to initiate the set of actions to be performed with respect to the moving component by providing a notification to the component comprising at least one of a visual, audio, or tactile alert, and wherein the second signal comprises a channel access protocol code that the component uses to determine whether the second signal is intended for the component, and wherein sending the second signal to the component allows the component to prepare for the moving component's arrival at the arrival point; and terminating the second signal responsive to the component moving away from a second selected distance of the arrival point.

2. A data processing system for automatically notifying a component of an approach of a moving component, the data processing system comprising:

a bus;

a storage device connected to the bus, wherein the storage device contains computer usable code;

at least one managed device connected to the bus;

a communications unit connected to the bus; and a processing unit connected to the bus, wherein the processing unit executes the computer usable code to receive a signal generated by a radio frequency identification tag located with the moving component, wherein the signal is generated when the moving component moves within a selected distance of an arrival point, and wherein the signal includes a unique identifier for the moving component; identify the moving component based on the unique identifier in the signal; send a second signal to the component to signal that initiation of a set of actions is to be performed with respect to the moving component, wherein the second signal is received by a second radio frequency identification tag located with the component, and wherein the second radio frequency identification tag includes a transponder, receiver, and a signaling device, and wherein upon receiving the second signal the signaling device alerts the component to initiate the set of actions to be performed with respect to the moving component by providing a notification to the component comprising at least one of a visual, audio, or tactile alert, and wherein the second signal comprises a channel access protocol code that the component uses to determine whether the second signal is intended for the component, and wherein sending the second signal to the component allows the component to prepare for the moving component's arrival at the arrival point; and terminate the second signal responsive to the component moving away from a second selected distance of the arrival point.

3. A computer program product for automatically notifying a component of an approach of a moving component, the computer program product comprising:

a tangible computer usable medium having computer usable program code embodied thereon, the computer usable program code comprising:

computer usable program code for receiving a signal generated by a radio frequency identification tag located with the moving component, wherein the signal is generated when the moving component moves within a selected distance of an arrival point, and wherein the signal includes a unique identifier for the moving component;

computer usable program code for identifying the moving component based on the unique identifier in the signal;

computer usable program code for sending a second signal to the component to signal that initiation of a set of actions is to be performed with respect to the moving component, wherein the second signal is received by a second radio frequency identification tag located with the component, and wherein the second radio frequency identification tag includes a transponder, receiver, and a signaling device, and wherein upon receiving the second signal the signaling device alerts the component to initiate the set of actions to be performed with respect to the moving component by providing a notification to the component comprising at least one of a visual, audio, or tactile alert, and wherein the second signal comprises a channel access protocol code that the component uses to determine whether the second signal is intended for the component, and wherein sending the second signal to the component allows the component to prepare for the moving component's arrival at the arrival point; and computer usable program code for terminating the second signal responsive to the component moving away from a second selected distance of the arrival point.

* * * * *